US008707607B2

(12) United States Patent
Williams et al.

(10) Patent No.: US 8,707,607 B2
(45) Date of Patent: Apr. 29, 2014

(54) GUN CLEANING TOOL KIT

(71) Applicant: The Otis Patent Trust, Lyons Falls, NY (US)

(72) Inventors: Nicholas Williams, Naples, FL (US); James R. Brooker, Constantia, NY (US)

(73) Assignee: The Otis Patent Trust, Lyons Falls, NY (US)

( * ) Notice: Subject to any disclaimer, the term of this patent is extended or adjusted under 35 U.S.C. 154(b) by 0 days.

(21) Appl. No.: 13/797,347

(22) Filed: Mar. 12, 2013

(65) Prior Publication Data

US 2013/0291421 A1 Nov. 7, 2013

Related U.S. Application Data

(60) Provisional application No. 61/641,592, filed on May 2, 2012.

(51) Int. Cl.

| | |
|---|---|
| ***F41A 15/00*** | (2006.01) |
| ***F41A 29/00*** | (2006.01) |
| ***F41A 35/00*** | (2006.01) |
| ***B65D 85/00*** | (2006.01) |

(52) U.S. Cl.

CPC ..... *F41A 29/00* (2013.01); *F41A 35/00* (2013.01); *B65D 85/70* (2013.01); *B65D 85/54* (2013.01); *B65D 85/00* (2013.01)

USPC ..... 42/90; 42/95; 42/106; 206/373; 206/362

(58) Field of Classification Search

CPC ..... F41A 29/00; F41A 35/00; B65D 85/00; B65D 85/54; B65D 85/70

USPC ..... 42/90, 95, 106; 206/373, 362, 361, 317

See application file for complete search history.

(56) References Cited

U.S. PATENT DOCUMENTS

| | | | | |
|---|---|---|---|---|
| 4,901,464 | A * | 2/1990 | Banoun | 42/95 |
| 7,165,673 | B2 * | 1/2007 | Marks | 206/373 |
| 7,841,472 | B1 * | 11/2010 | Williams | 206/579 |
| 7,987,626 | B2 * | 8/2011 | Williams | 42/95 |
| 8,371,441 | B2 * | 2/2013 | Williams | 206/317 |
| 2007/0068835 | A1 * | 3/2007 | Buie, II | 206/373 |
| 2013/0032501 | A1 * | 2/2013 | Williams | 206/361 |

* cited by examiner

*Primary Examiner* — J. Woodrow Eldred
(74) *Attorney, Agent, or Firm* — Harris Beach PLLC

(57) ABSTRACT

A gun cleaning tool kit, comprising an openable case, at least one mount for receiving a removable tool insert, a portable miniature gun cleaning tool kit disposable in the openable case, a foldable work surface apron. The kit may further comprise at least one removable tool insert, a plurality of gun cleaning tools disposed on the removable tool insert, and an exterior pocket formed in the openable case for storing the portable miniature gun cleaning tool kit. Preferably, the foldable work surface apron is removably attached to, and stored within, the openable case. Preferably, both the openable case and the portable miniature gun cleaning tool kit are closable by zippers.

17 Claims, 12 Drawing Sheets

GUN CLEANING TOOL KIT

The present application draws priority from a pending provisional U.S. Provisional patent application, Ser. No. 61/641,592, filed May 2, 2012.

FIELD OF THE INVENTION

This invention relates generally to the field of firearm cleaning kits, and more particularly to a storage compartment for a firearm cleaning kit.

BACKGROUND OF THE INVENTION

Proper cleaning of a firearm after use is essential to ensuring the firearm retains its accuracy, safety, and reliability. With each firing, the breech and bore of a firearm accumulate residue such as powder, priming compound, paper, plastic and fiber linings and wadding, and copper fragments from ammunition casings. In addition, environmental elements such dirt, snow, and moisture can accumulate in the bore, causing further fouling. Fouling and debris may also accumulate in the firearm's action due to its design, or improper maintenance. Failure to remove the residue and debris results in a decrease in the firearm's accuracy and precision, and may even pose a safety hazard to the operator. Therefore, proper cleaning is one of the most important elements of firearm ownership.

Civilians who shoot and clean firearms often devise their own storage cases to store firearm cleaning materials. An example is an empty ammunition can. In many instances, firearm owners also fashion their own tools to aide in the cleaning process. However, these homemade storage cases and cleaning tools are generally not portable or lightweight. When cleaning a firearm, components or cleaning tools may be set aside during the cleaning process and, due to their small size, may be misplaced or lost. Therefore, civilians have a need for a lightweight and compact firearm cleaning kit that stores cleaning tools and provides additional storage capability.

The military, police forces, and security companies use various types of weapons, including handguns, shotguns, semi-automatic rifles, assault rifles, machine guns, and grenade launchers, referred to herein collectively as "guns," "weapons," or "firearms". Military personnel and law enforcement officers need to be able to clean their weapons in the field, preferably immediately after shooting so that their firearm is ready for use at all times. An important aspect of the cleaning process is that the cleaning kit be compact and lightweight, organized, and able to store firearm components or spare tools and cleaning supplies. Therefore, military personnel also need a lightweight and compact firearm cleaning kit that stores cleaning tools and provides additional storage capability for the cleaning of military weapons.

Cleaning a weapon typically requires some disassembly of the weapon in order to gain access to component surfaces and mechanisms that are otherwise within a firearm, such as the firing chamber and receiver. Under field conditions, it can be difficult to keep track of disassembled components, and to keep cleaned components free of dirt before being reassembled.

Military personnel need to be able to clean their weapons in the field, preferably immediately after shooting so that their firearm is ready for use at all times. An important aspect of the cleaning process is that the cleaning kit be compact and lightweight, organized, and able to store firearm components or spare tools and cleaning supplies. Therefore, military personnel also need a lightweight and compact firearm cleaning kit that stores cleaning tools and provides additional storage capability for the cleaning of military weapons. The number and variety of cleaning tools required for cleaning all the types of weapons that a soldier may be called upon to use can number in the dozens, comprising multiple types of brushes, scrapers, picks, punches, patches, swabs, rods, cables, backings which may be proprietary, attachment mechanisms, and the like, referred to collectively herein as "tools". A full kit of all such tools can weigh several pounds and be very bulky, encumbering a soldier unduly. It has been estimated that a combat loaded infantryman carries between sixty and eighty pounds of field equipment, including firearm and ammunition.

To answer the need for portable, compact, and lightweight storage cases for firearm cleaning materials and tools, many different types of firearm cleaning kits have been designed for military and consumer use. Specialized, compact cleaning kits have been custom-designed to store the precise tools and components needed to thoroughly clean a particular firearm. For example, firearm cleaning tool kits have been designed to store specific cleaning tools such as brushes, picks, scrapers, and rods.

On any given field deployment or mission, however, a soldier may need only a small fraction of all the tools available in the kit, and the cleaning tools that will be needed may in some instances be determined in advance of the deployment or mission. Thus, a need exists for a convenient and configurable gun cleaning tool kit that can provide a flexible combination of the tools needed for a specific mission, together with a compact case for taking such subsets and combinations of the tools on one's person, but which also includes a case having a full complement of cleaning tools and supplies in a transportable tool kit that provides the full range of tools and accessories required for cleaning a full range of weapons in the field during an extended deployment, for example, at a forward operation base or location.

SUMMARY OF THE INVENTION

Briefly stated, the embodiments disclosed herein describe a configurable tool kit for cleaning of firearms.

According to one aspect, the invention features a gun cleaning tool kit, comprising a first case configured to be selectively attached to equipment worn by a gun user, the first case has an elongated attachment element affixed to the interior surface of the case and a detachable tool insert which defines a plurality of cavities for selectively holding a plurality of gun cleaning implements, The tool insert has a clamping element configured to selectively engage the elongated attachment element.

According to another aspect, the invention may feature a second case comprising a first side and a second side joined along a fold line and a fastener for joining together the sides together. The second case also has an elongated attachment element affixed to its interior surface which is also configured to engage the clamping element of said tool insert. The first case may be sized and configured to fit within an externally accessible pocket, which may protrude through one side of the second case to occupy a portion of the interior space of the second case.

According to yet another aspect, the externally accessible pocket may also be accessible from the interior of the second case.

According to yet another aspect, the second case may include an internal pocket, which may preferably have a fastener adjacent the opening of the internal pocket. The internal pocket holds an apron comprised of a sheet of solvent-resistant fabric selectively positionable between a first stored position folded within said first internal pocket and a second deployed position unfolded outside of said internal pocket, said unfolded apron defining a gun cleaning work area. The apron is preferably resistant to the absorption of water, solvents and oils. In another aspect, the apron is a sheet of rubberized fabric that may be wiped clean prior to storage within the internal pocket.

According to yet another aspect, the tool gun cleaning kit comprises a plurality of gun cleaning implements selected from the group of brushes, bore brushes, chamber brushes, slotted tips, obstruction remover tips, adapters, punches, picks, scrapers, rods, rigid rods, flexible rods, cables, patches, swabs, applicators, spray applicators, gun cleaning cloths, lens cleaning cloths, solvents, gun cleaning solvents, lens cleaning solvents, and lubricants.

In another embodiment, the gun cleaning tool kit may comprise a case having a first side and a second side joined along a fold line, a fastener for joining together the sides together, a first internal pocket having a first fastener element adjacent to an opening of said first pocket; and a second externally accessible pocket protruding through one of first sides into the internal space of the case which is preferably sized and configured to hold a personal gun cleaning kit selectively worn by a gun user.

In yet another aspect, the embodiment may include an apron of solvent-resistant fabric having a complementary fastener element to be selectively attached or detached from the case. The apron may be stored folded within an internal pocket of the case or deployed and unfolded to define a gun cleaning work area.

In yet another aspect, gun cleaning kit further comprises one or more tool inserts each of which holds a plurality of gun cleaning implements. Preferably, the multiple tool inserts are compatible and may be selectively placed within a small personal sized case worn by a gun user or securely stored within a large gun cleaning tool kit case.

Disclosed embodiments described herein provide a generally rectangular soft case that unzips along three sides so that the opened case may be opened to a flat condition which is divided into two portions connected by a fastener such as a fabric fold line. Alternatively, the two portions of the case may be connected by one or more hinges along the joined edge between the case portions or sides.

One portion or side of the case is provided on the inside with a plurality of pockets, pouches or sections for storing and carrying a plurality of cleaning items, e.g., brushes, tips, swabs, patches, scrapers, picks, punches, rods, cables, adapters, cleaning fluids, solvents, lubricants, and the like. One portion or side of the case may include one or more selectively closable pockets, netting or pouches into which a wide variety of gun cleaning implements may be placed and stored. One of the pockets may include a fixed or selectively detachable apron, which is preferably formed of non-absorbent cloth. The apron is preferably impermeable to water, gun cleaning solvents, lens cleaning solvents, lubricants and preservatives. The apron may be removed from the pocket and unfolded to define as a clean, dry, gun cleaning surface of sufficient size to lay out the disassembled components of a firearm. There solvent-resistent cloth defines a work area for performing various field-cleaning operations. The apron may be attached to the inside of the case by any suitable fastener including snaps, zippers and hook and loop fasteners.

The second portion or side of the case may be provided on the inside with pockets and with at least one mount for removably attaching a tool kit insert for carrying a variety of weapon-cleaning tools, such as is disclosed in U.S. patent application Ser. No. 12/688,392, filed Jan. 15, 2010, now U.S. Pat. Nos. 7,841,472 and 8,371,441 titled GUN CLEANING KIT TOOL INSERT. The invention described in U.S. Pat. Nos. 7,841,472 and 8,371,441 is assigned to the assignee hereof, the disclosure of which are incorporated by reference herein. The tool kit insert may be selectively secured to a fastener element affixed to the interior of the case, and defines a plurality of gun cleaning tool cavities. The fastener or attachment element may be releasably secure the tool insert to the interior of the case. The complementary attachment mechanism comprises a generally cylindrical member affixed to the interior of the case and a detachable portion, which is preferably a C-shaped clamp. The clamp is preferably formed of plastic or rubber and having sufficient elasticity to expand over and around at least half of the generally cylindrical attachment member. The attachment element further comprises a clamp and a cylindrical element, the clamp defining a bore along a longitudinal axis thereof, the cylindrical element is adapted for slidable engagement with the bore. Although the preferred embodiment of the attachment element is cylindrical, elongated members having various rounded or polygonal cross sections are contemplated to be within the scope of the invention.

Further, an additional pocket is formed that preferably opens to the outside of the tool case for storing a personal and wearable gun cleaning tool kit. The case of the personal tool kit is configured and adapted to be selectively attachable to the clothing, harnesses and gear (collectively "equipment") worn by a service member, law enforcement official, or other gun user. In an alternative embodiment, the additional pocket may also open from the interior of the case or from both the interior and exterior of the case. The additional pocket may be closable with a flap, snap or zipper and defines a space for holding a personal or smaller tool kit that is sized and adapted to be worn by or carried into the field. The smaller or personal tool kit may be stocked with specific tools from the larger, parent tool kit as may be needed for a particular mission requiring specific weapons. Preferably, the miniature tool kit also incorporates tool kit inserts having a fixed attachment element compatible with the detachable portion of the one or more tool kit inserts included in the kit. Flexibility to the service member is provided by having multiple tool inserts or inserts that are compatible with differing combinations of the variety of tools included in the kit. Consequently a service member can personally configure the miniature tool kit to carry only the minimum or basic tools necessary to the service member for a particular patrol, posting or mission, while having access to the full range of tools in the complete kit and a selectively detachable fabric apron upon which to perform more complete cleaning processes when the service member returns to base. Thus, the light-weight miniature tool kit may be taken into the field or on patrol for immediate use, while the larger parent tool kit remains at a central base.

The smaller, personal tool kit comprises a soft case that unzips, like the parent kit, along three sides so that the case is divided into two portions connected by a fastener such as a fabric fold line, clip or hinge. The smaller, personal tool kit includes an attachment element operably similar to the attachment element in the larger, parent kit for removably receiving a tool insert, and includes various other cleaning implements, for example, brushes, slotted tips, swabs, sections of cleaning rigid or flexible cleaning rods, cable extensions, and cleaning solvents.

The larger tool kit has sufficient storage for additional cleaning solvents, cleaners, patches and special purpose cleaning fabrics for cleaning a variety of weapons as well as firearm accessories such as laser-optic siting systems, visual scopes, accessory visual, infra-red and radio frequency sources and sensors. The larger tool kit has additional storage for a variety of brushes including bristles of varying stiffness and materials such as nylon, brass and steel to complete a variety of gun cleaning tasks. The tool kit may also have a series of bore and chamber brushes to clean the full range of weapons used or potentially used by a service member.

The foregoing and other features of construction and operation of the disclosed embodiments will be more readily understood and fully appreciated from the following detailed description, taken in conjunction with accompanying drawings.

DETAILED DESCRIPTION OF DISCLOSED EMBODIMENTS

Figure 1:
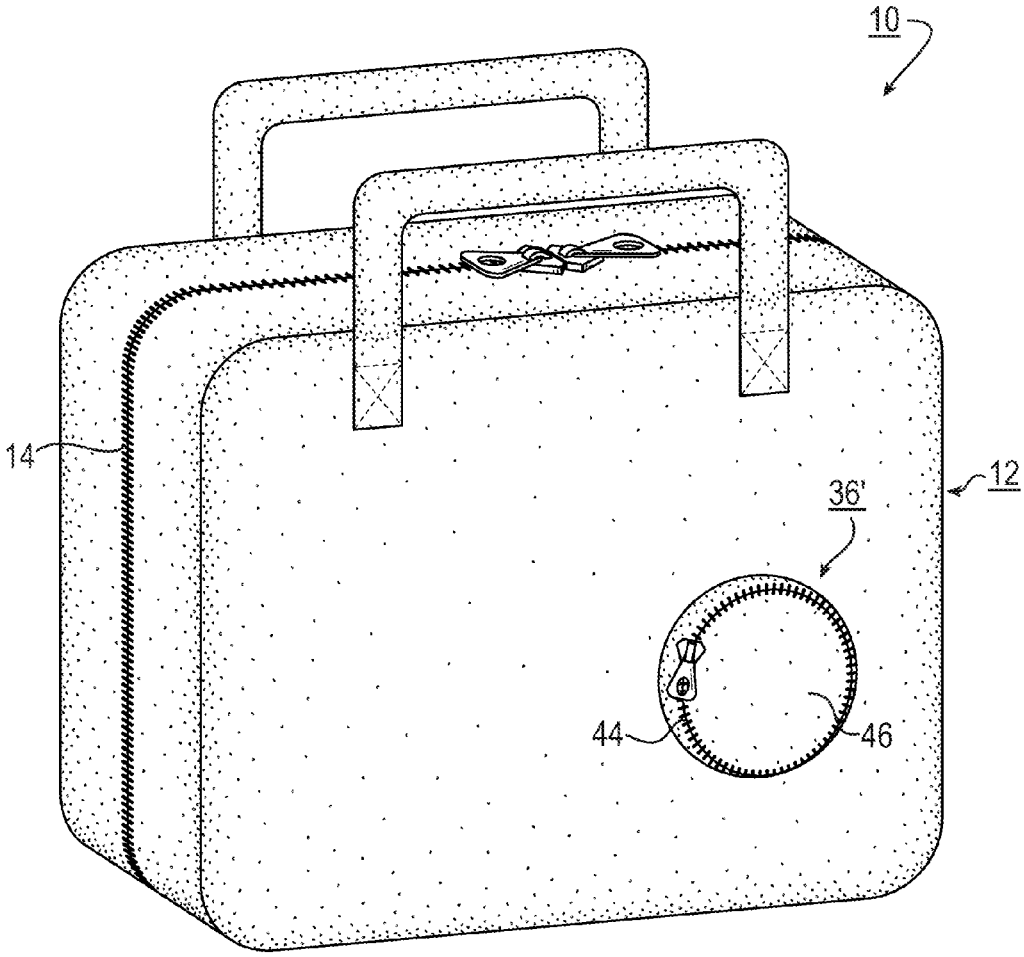
FIG. 1 is a perspective view of the exterior of a firearm cleaning kit according to an embodiment of the invention.
Figure 2:
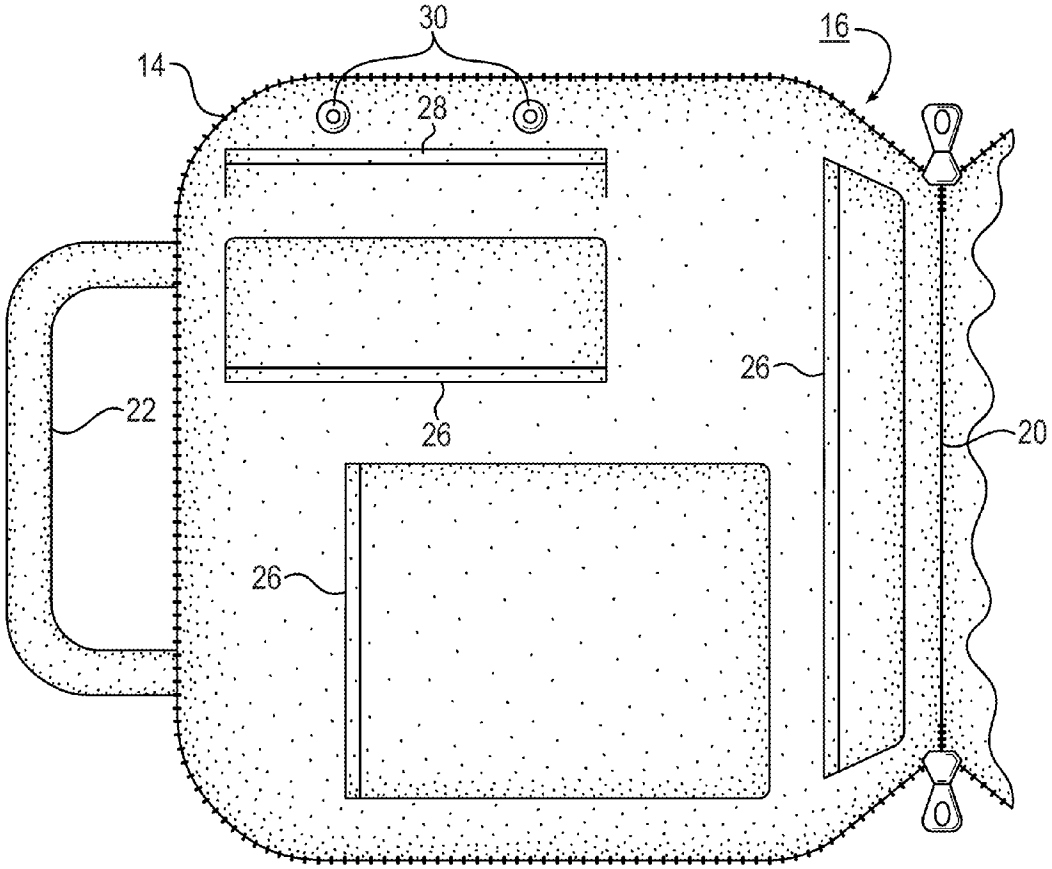
FIG. 2 is an elevational view of the interior a first portion of the case of a firearm cleaning kit according to an embodiment of the invention.
Figure 3:
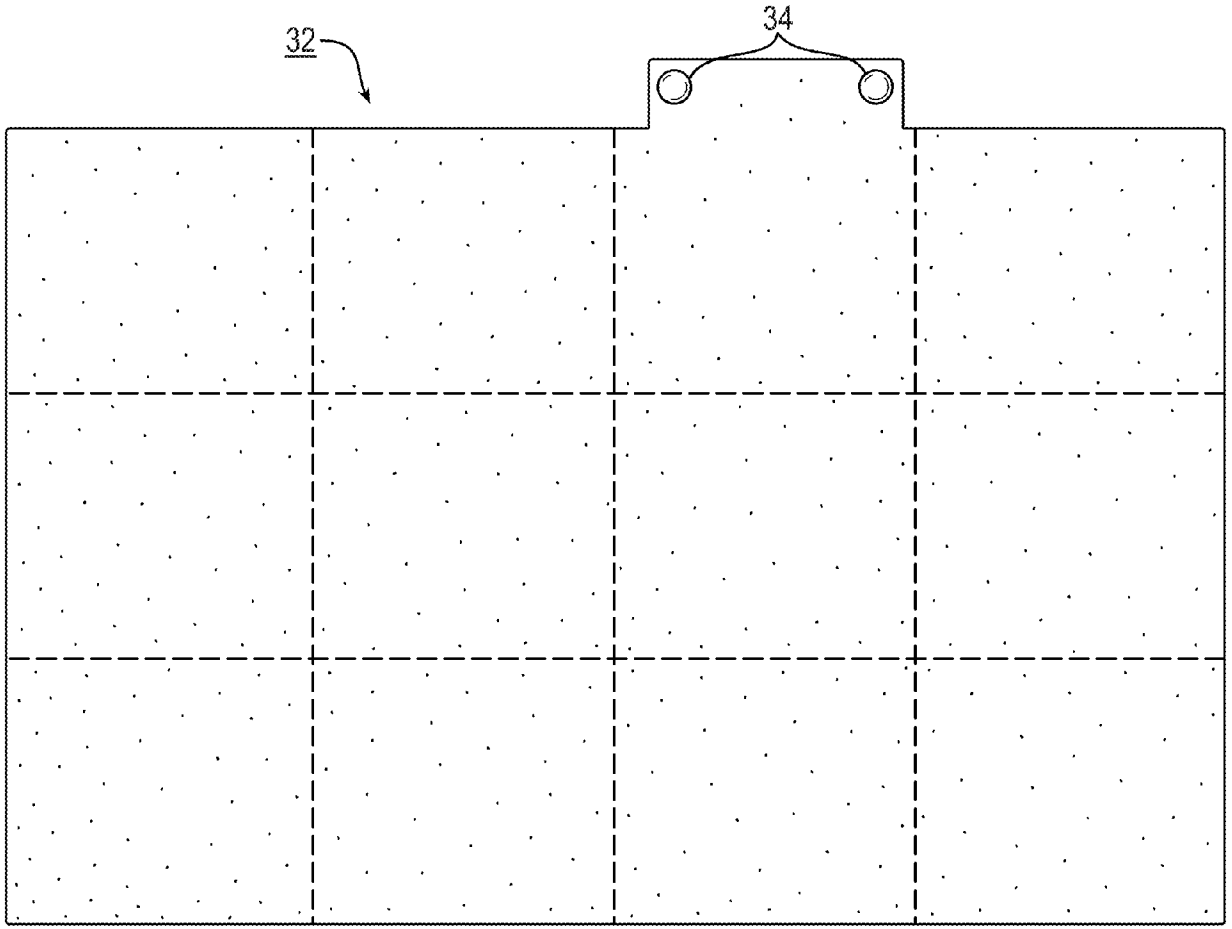
FIG. 3 is an elevational view of the unfolded detachable apron of a firearm cleaning kit shown in FIG. 1.
Figure 4:
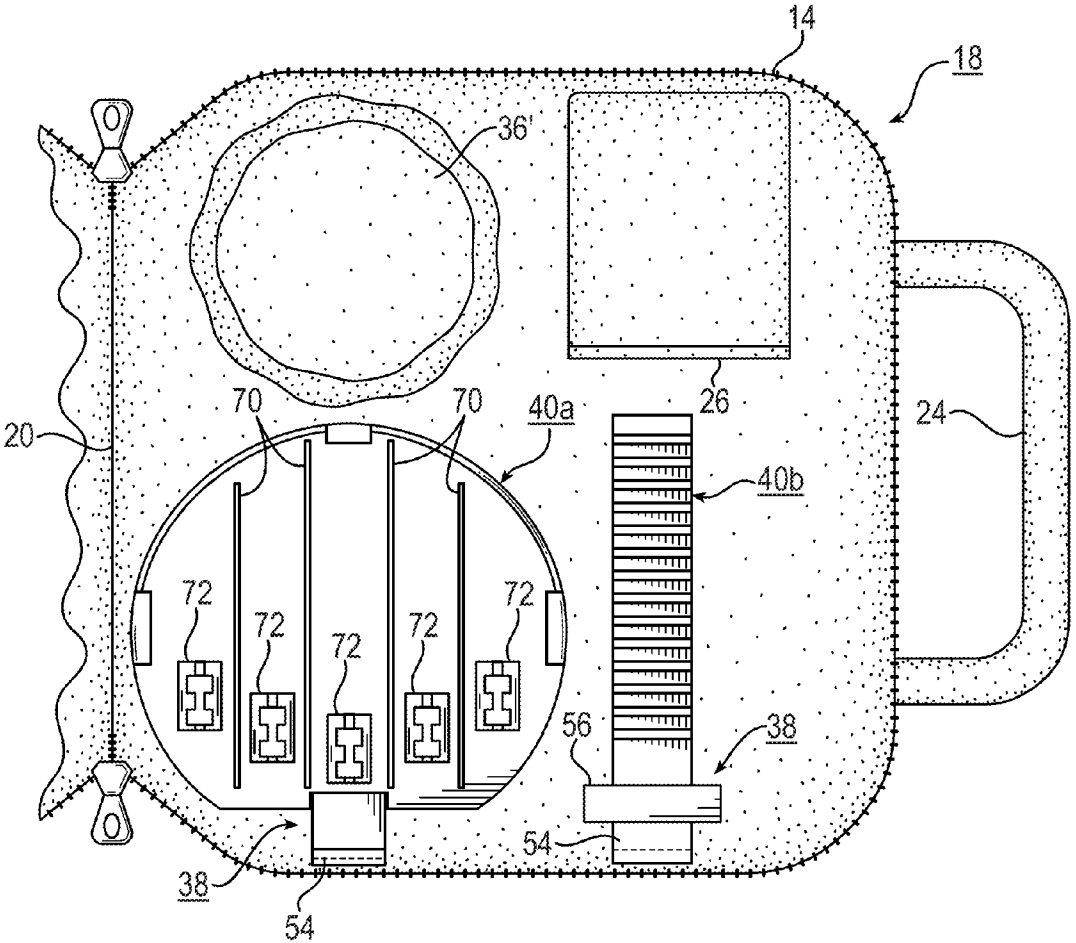
FIG. 4 is an elevational view of the interior of a second portion of the case of a firearm cleaning kit according to an embodiment of the invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Referring to FIGS. 1 through 5, a gun cleaning tool kit 10 in accordance with the present invention comprises a soft, durable canvas case 12 that includes fastener shown in the preferred embodiment as a zipper 14 along three sides so that the case is divided into two portions 16,18 connected by a fabric fold line 20. In alternative embodiments, the fastener could be one or more snaps, clips, straps, buckles, interlocking tabs, interlocking edge fasteners, or sliding edge fasteners. Preferably portions 16,18 include first and second canvas handles 22,24. While any number of canvases or abrasion resistant fabrics may be used to form the case, a common material used for luggage or backpacks includes fabric of 100% synthetic fibers or blends with cotton or other natural fibers known under the brand name CORDURA may be used.

Figure 12:
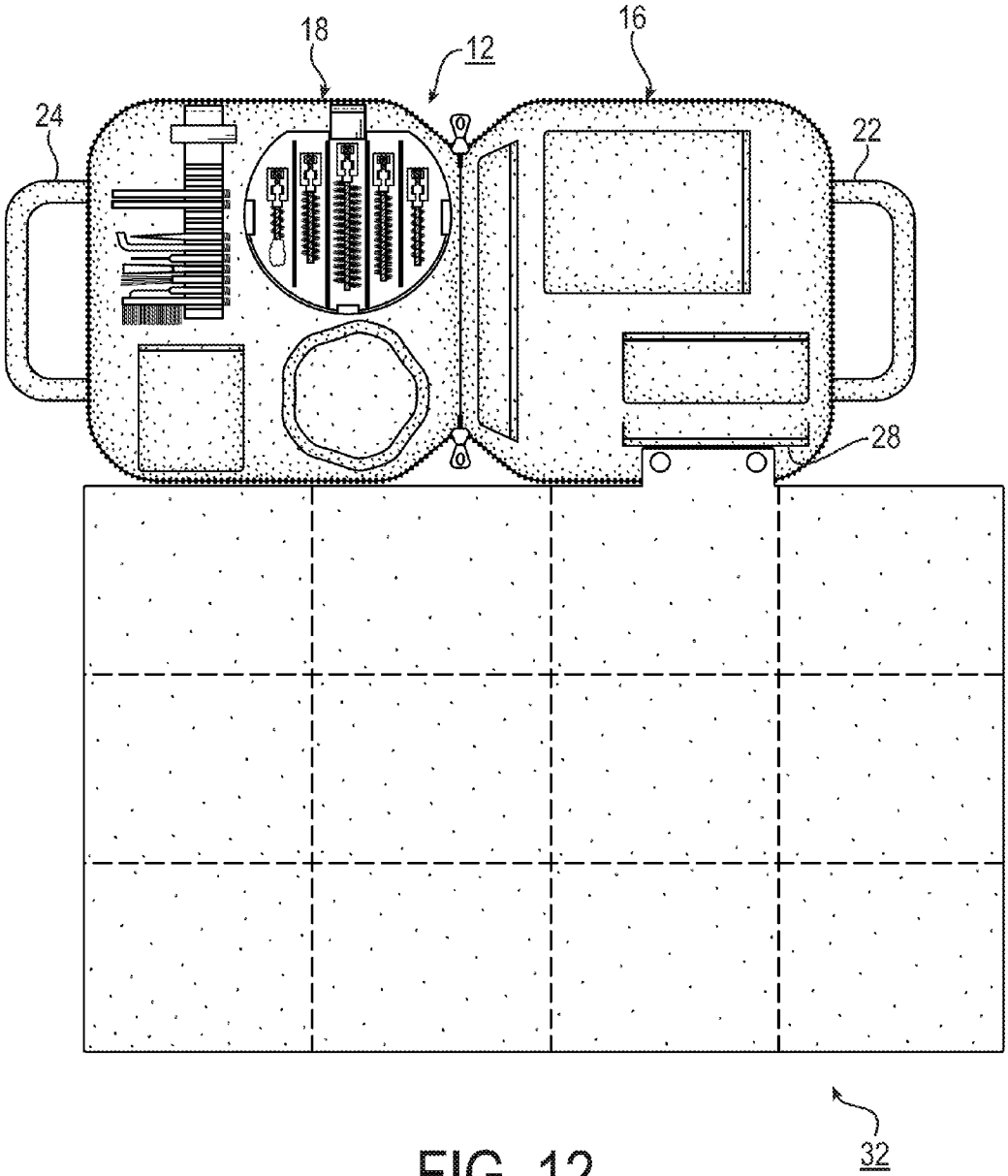
FIG. 12 is another perspective view of the open case of the gun cleaning tool kit depicting the apron in a deployed, unfolded position.
Figure 13:
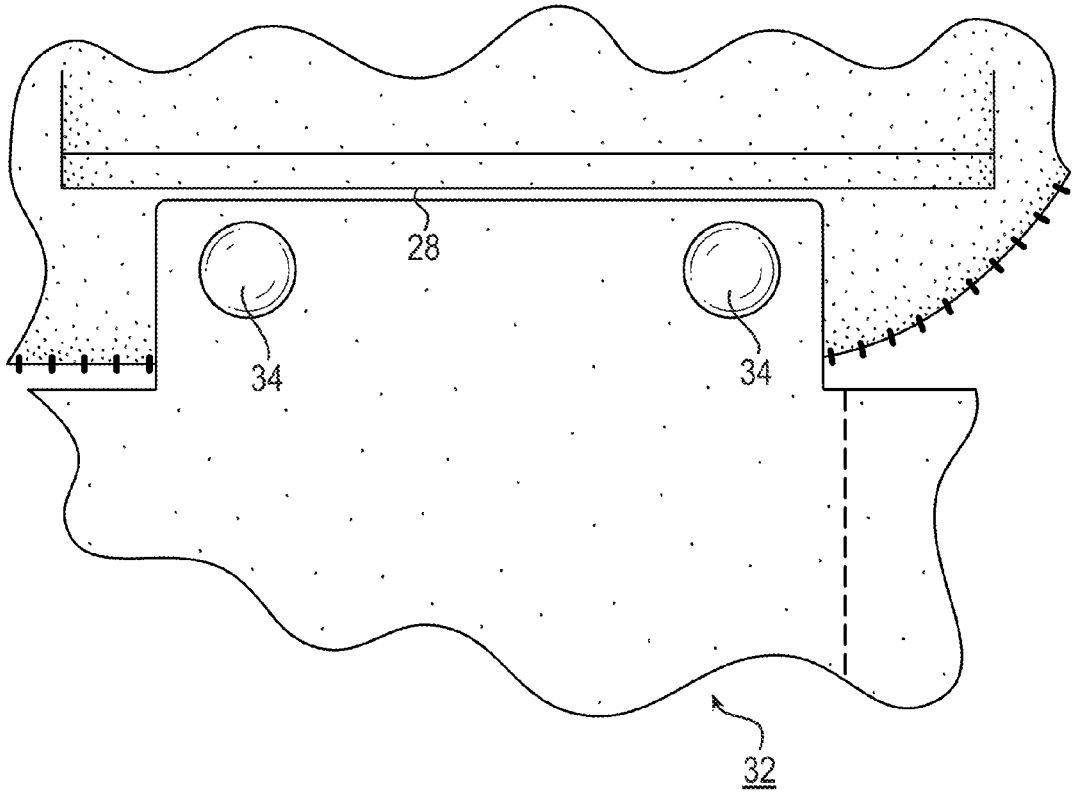
FIG. 13 is an elevational view of the selective attachment fastener of the apron and an interior pocket of the case of one embodiment of the invention.

In an exemplary embodiment, one portion or side 16 of case 12 is provided on the inside with a plurality of pockets 26 in a variety of shapes and sizes for storing and carrying a plurality of cleaning items, e.g., elongated brushes, swabs, patches, flexible or rigid rods, and the like, as described herein. An internal pocket 28 may include one or more snaps, tabs or other fasteners 30 attached to interior of kit case 12 and holds a foldable waterproof fabric apron 32 (FIGS. 3, 12 and 13) that can be unfolded, while attached or detached from kit 10, to define a clean, dry, cleanable work area and surface for performing various weapon-cleaning operations as are known in the weapon arts. In an exemplary embodiment, unfolded the apron is approximately twenty inches by thirty inches, or otherwise sufficiently sized to permit a soldier or other gun user to lay out and keep track of disassembled firearm components, and to keep cleaned components free of dirt before being reassembled. The apron 32 is formed of a solvent-resistant fabric that will not absorb or collect any of the various solvents used during gun cleaning operations, including water-based and oil-based cleaning solvents, lens cleaning solution, petroleum distillates, lubricants, corrosion inhibitors, graphite powder, grease and oil. In a preferred embodiment, the apron is formed of a rubber coated fabric such as fabric layer rubber sheet or a fabric impression rubber sheet.

Apron 32 may include complementary snap closures 34 that mate with closures 30. In alternative embodiments, the apron and case may include any common fastener including zippers, snaps, hook and loop fasteners, and the like. In another alternative embodiment, the apron may have no such fasteners, but comprise a simple sheet of fabric that may be folded and separately stored within internal pocket 28.

Figure 11:
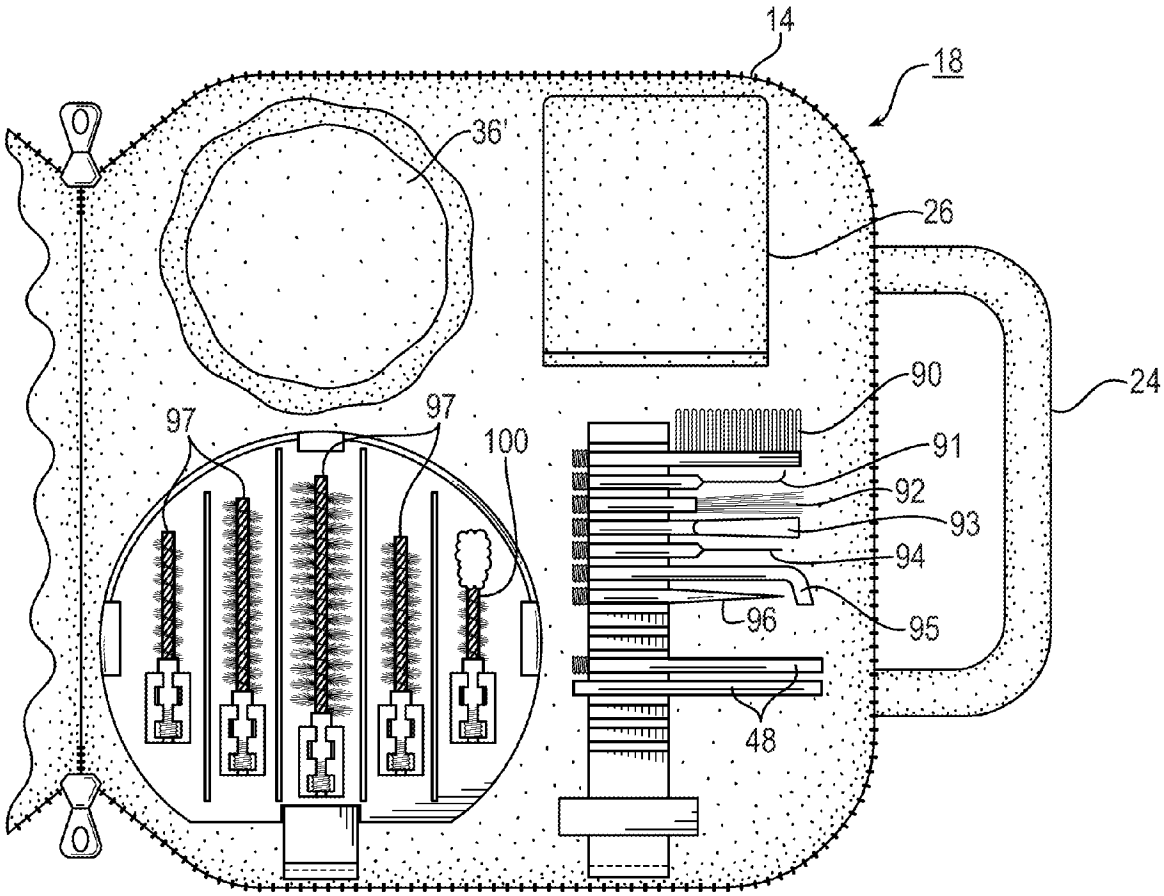
FIG. 11 is an elevational view of one portion of the gun cleaning kit case depicting the tool inserts attached to the interior of the case and holding a variety of gun cleaning implements.

Second and opposing portion or side 18 of case 12 may be provided on the inside with a one or more of pockets 36 and with one or more mount or attachment elements 38 for selectively attaching a tool insert 40*a*, 40*b* for removably holding or storing a variety of gun cleaning implements or tools 41, such as brushes, tips, swabs, patches, scrapers, picks, punches, rods, cables, adapters, cleaning fluids, solvents, lubricants, and the like. FIG. 11 depicts a variety of such tools including toothbrush-style brush head 90, right angle pick 91, tip brush 92, scraper 93, pick 94, bent-tip corrugated scraper 95, punch 96, rod sections 48, bore brushes 97, slotted tips 98, obstruction remover tips 99, specialized brushes including chamber brushes, integrated swab and bore brush 100.

Figure 6:
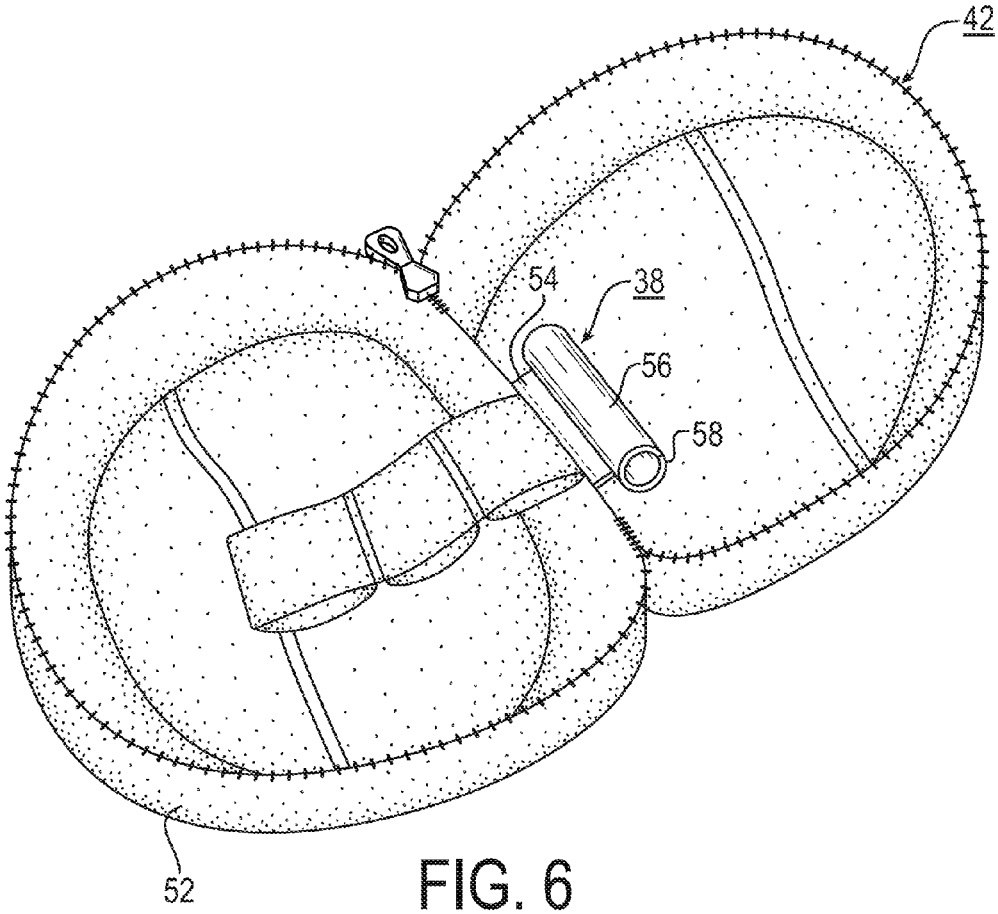
FIG. 6 is a perspective exterior view of an exemplary miniature tool kit case of a firearm cleaning kit shown in FIG. 1.
Figure 7:
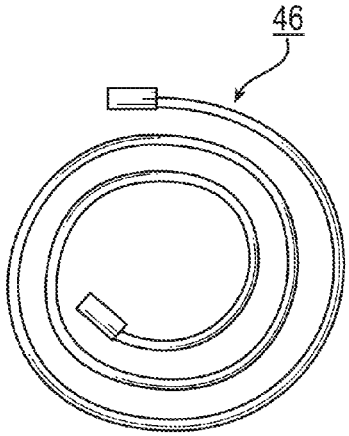
FIG. 7 is an elevational view of a flexible rod having fittings adapted to connect to a variety of gun cleaning implements of a firearm cleaning kit according to one embodiment of the invention.
Figure 8:
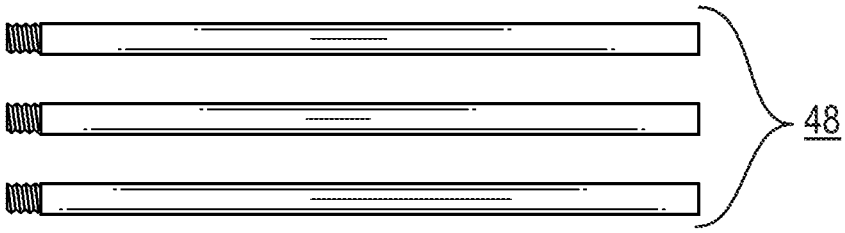
FIG. 8 is an elevational view of a series of rigid rod sections engageable to each other as well as to a variety of gun cleaning implements of a firearm cleaning kit according to one embodiment of the invention.
Figure 9:
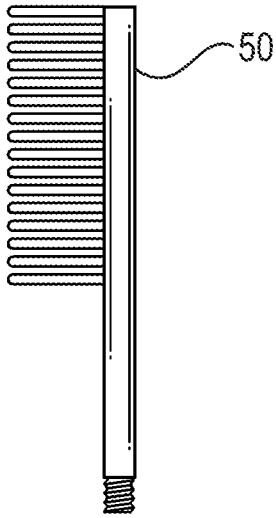
FIG. 9. is an elevational view of a gun cleaning brush head engageable to one or more sections of rigid rods of a firearm cleaning kit according to one embodiment of the invention.
Figure 10:
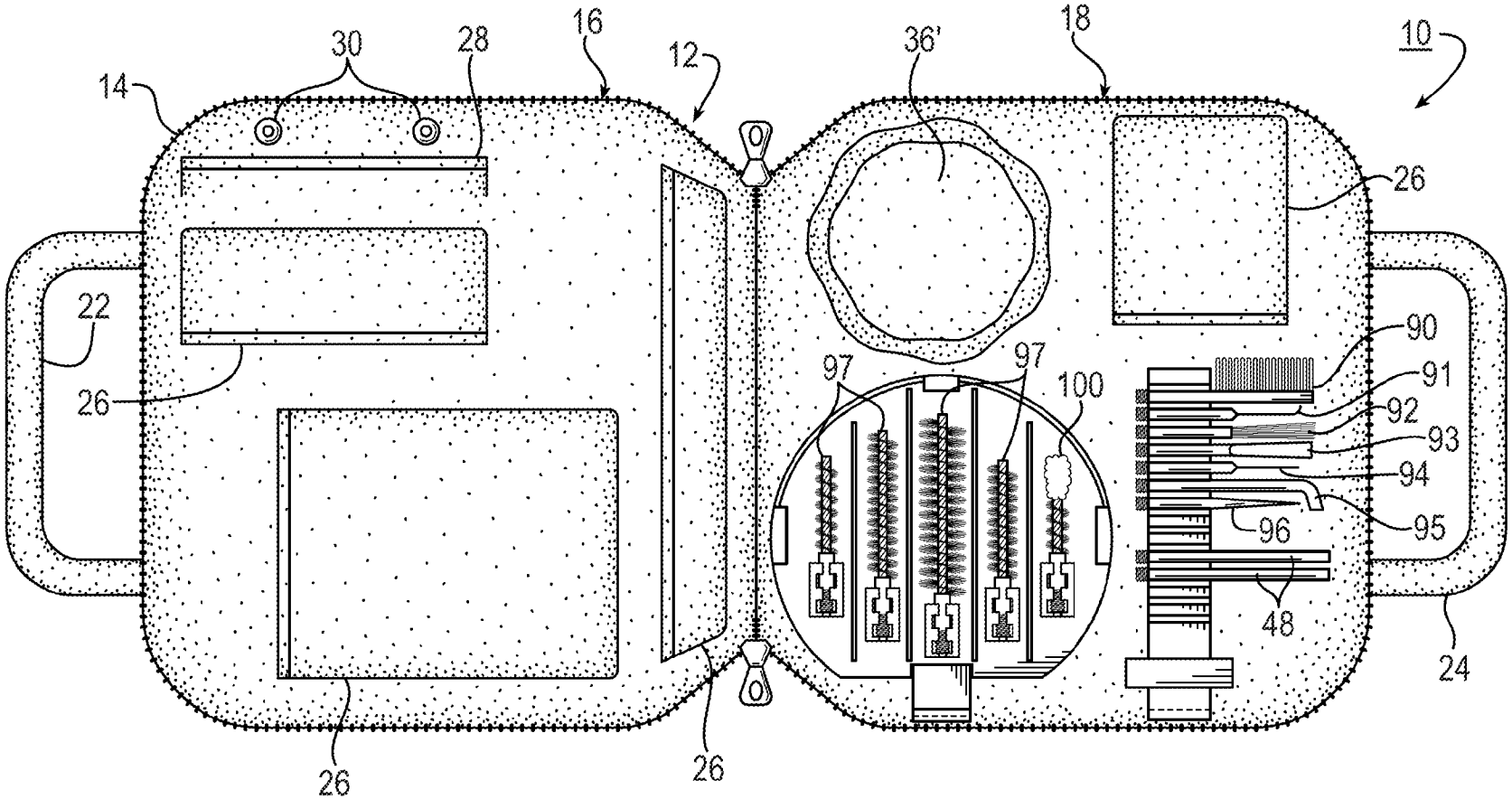
FIG. 10 is an elevational view of a gun cleaning kit lying flat in the open position.

Further, a pocket 36' is formed in the side of portion 18 that, in one embodiment, pocket 36' opens from the exterior of the tool kit case 12 for storing a smaller, personal tool kit 42 depicted in FIG. 6. External access to the smaller, personal tool kit allows a user to retrieve and use one's preferred combination of available tools readily stored in the personal kit. In alternative embodiments, the pocket 36' may also be accessible from the inside of the case. In yet another embodiment, pocket 36' may be accessible from both the interior and the exterior of the case 12. Outside pocket 36' is zipper-closed 44 with a flap 46. Smaller, personal tool kit 42 may be stocked with specific tools from the larger parent tool kit, e.g., a cleaning cable 46, a knock-down screw-together cleaning rod 48 (FIG. 8), or a compact brush 50, as may be needed for a particular mission requiring specific weapons. Thus, lightweight personal tool kit 42 may be taken into the field for immediate use, while the heavy parent tool kit 10 remains at an operating base. Some embodiments of smaller personal tool kits contain sufficient tools, cleaning solvents, rods, cables, and patches to perform numerous cleaning cycles of a range of weapons. A variety of configurations of such kits are known and depicted on assignees website available on the Internet at http://www.otisgun.com. Consequently, such personal tool kits may have thicknesses ranging from one to three inches. Particularly with respect to thicker personal tool kits, the pocket 36' is formed to protrude into the interior space of the case 12 as seen in FIGS. 10, 11 and 14. Forming the pocket 36 to protrude through the side of the case reduces the overall profile of the case which is preferred for compactness of the kit and ready access to cleaning implements.

Figure 5A:
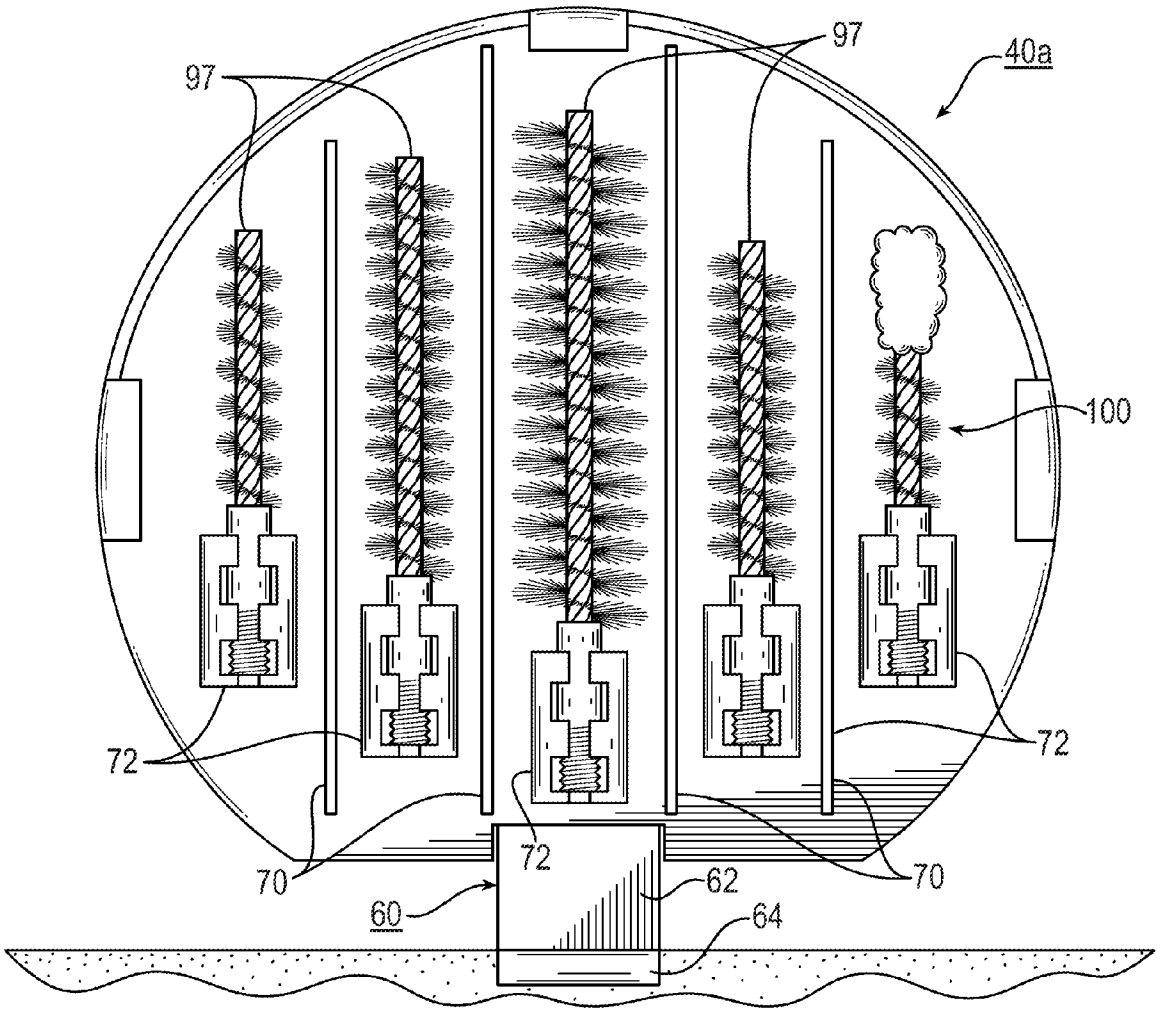
FIG. 5A is an elevational view of a first side of a detachable tool insert of an exemplary embodiment of the invention.
Figure 5B:
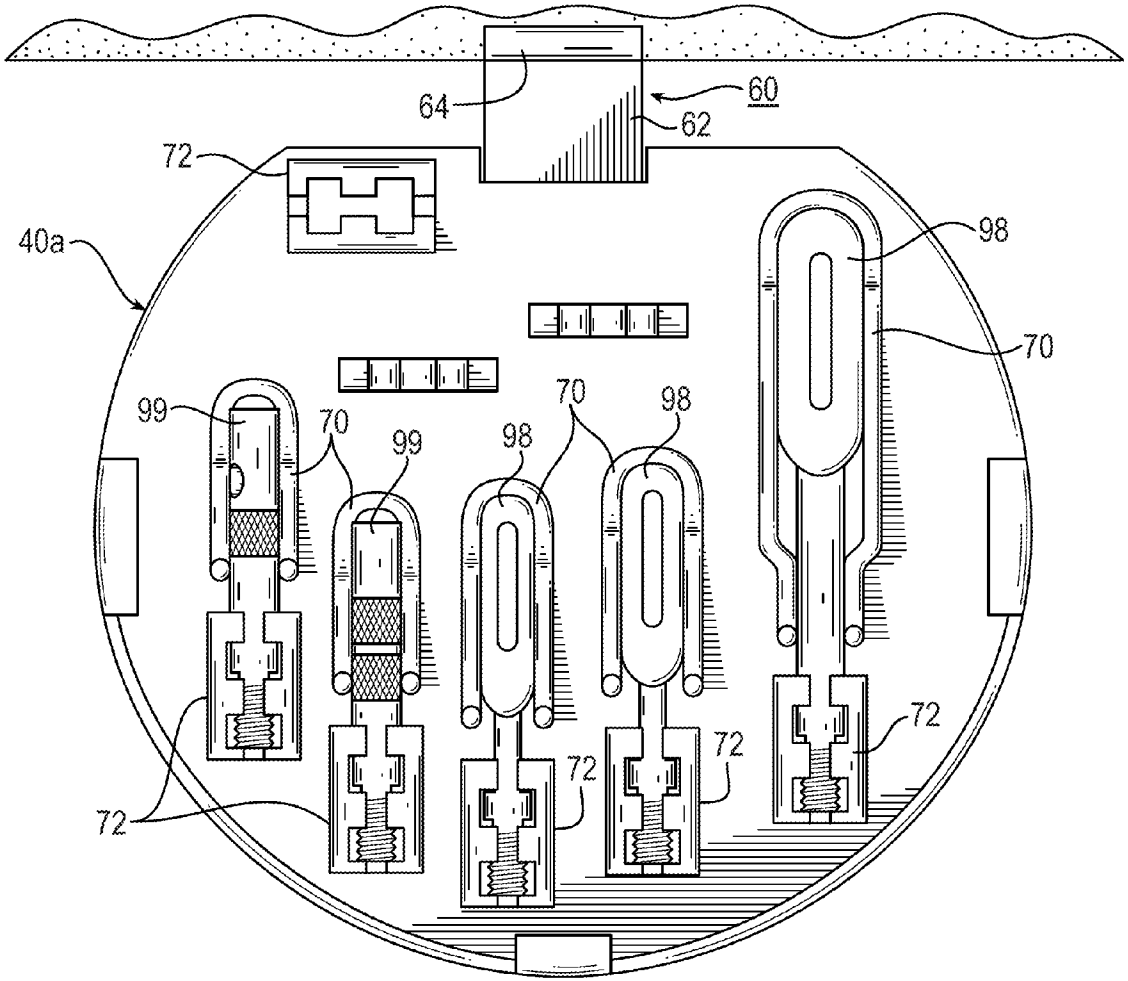
FIG. 5B is an elevational view of a second opposing side of a detachable tool insert of an exemplary embodiment of the invention.

Smaller, personal tool kit 42 comprises a soft case 52 having a zipper fastener, like the parent kit, along three sides so that the case is divided into two portions connected by a fabric fold line. See FIG. 6. The personal tool kit preferably also includes an attachment element 38 operably similar to attachment element 38 in the larger, parent kit case 12. Attachment element preferably includes an elongated, generally cylindrical member 56. Complementary fastener 60 in FIG. 5 is preferably a C-shaped clamp generally formed of plastic or rubber and has sufficient elasticity to selectively attach to cylindrical member 56 for removably receiving a tool insert 40*a*. Tool insert 40*a* may include protruding dividers 70 and receivers 72, which defines cavities into which a variety of gun cleaning implements are held and stored. See FIGS. 5A, 5B and 11. In one embodiment, tool insert 40*a* includes dividers and receivers on both opposing sides of the tool insert in order to fit and organize a greater number of gun cleaning implements. Exemplary tool arrangements are disclosed in FIGS. 5A, 5B and 11. Kit 42 preferably includes at least one pocket in each side, may include an elastic strap for carrying bottles or vials of solvent, tubes for holding specially shaped brushes, and the like.

Attachment element 38 comprises a tab 54 sewn into case 12 or personal tool kit 42 and a cylindrical C-shaped clasp or clamp 56 preferably having an alignment slot 58. Tool insert 40*a* includes an attachment portion 60 comprising a neck 62 and a complementary cylindrical element 64 that selectively mates with complementary cylindrical attachment clasp 56. While in one embodiment, the C-shaped clasp or clamping member is affixed to the interior of the case 12, 42, and generally cylindrical attachment member is affixed to the base of the tool insert 40*a*, it is contemplated that such attachment members may be reversed without affecting the function or operation of the kit.

Although the disclosed embodiments have been disclosed for illustrative purposes, those skilled in the art will appreciate that various modifications, additions and substitutions are possible, without departing from the scope and spirit as disclosed in the accompanying claims. It will be further understood that the above description of embodiments is by way of illustration only and is not to be construed as limiting the claims to any single embodiment.

What claimed is:

1. A gun cleaning tool kit, comprising:

a) a first case configured to be selectively attached to equipment worn by a gun user, said first case having an interior surface; a first elongated attachment element affixed to the interior surface; and a detachable tool insert, said tool insert defining a plurality of cavities for selectively holding a plurality of gun cleaning implements; and said tool insert having a clamping element configured to selectively engage said first elongated attachment element;

b) a second case comprising a first side and a second side joined along a fold line;

a. a fastener for joining together the first side and second side of said second case to define an interior surface of said second case b. a second elongated attachment element affixed to the interior surface of said second case, said second attachment element configured to engage the clamping element of said tool insert;

c. a first internal pocket; and d. a second externally accessible pocket sized and configured to hold said first case;

c) an apron comprised of a sheet of solvent-resistant fabric selectively positionable between a first stored position folded within said first internal pocket and a second deployed position unfolded outside of said internal pocket, said unfolded apron defining a gun cleaning work area; and d) a plurality of gun cleaning implements.

2. The gun cleaning tool kit in accordance with claim 1 wherein said second externally accessible pocket protrudes through one of the first side and second side of the second case into an internal space defined between the first side and the second side.

3. A gun cleaning tool kit in accordance with claim 1 wherein the second case further comprises a first fastener element adjacent to an opening of said first pocket and said apron further comprises a second fastener element complementary to said first fastener element.

4. A gun cleaning tool kit in accordance with claim 1 wherein said apron is resistant to the absorption of water, lens cleaning fluid and gun cleaning solvents.

5. A gun cleaning tool kit in accordance with claim 4 wherein said apron comprises a sheet of rubberized fabric.

6. A gun cleaning tool kit in accordance with claim 1, wherein the plurality of gun cleaning implements comprises at a plurality of sections of rods adapted to be joined together.

7. A gun cleaning tool kit in accordance with claim 6 wherein said plurality of rods includes at least one flexible cable.

8. A gun cleaning tool kit in accordance with claim 1 wherein said plurality of gun cleaning implements further comprises a gun cleaning solvent.

9. A gun cleaning tool kit in accordance with claim 1 wherein said second externally accessible pocket is accessible through the interior surface of said second case.

10. A gun cleaning tool kit, comprising:

a case comprising a first side and a second side joined along a fold line;

a. a fastener for joining together the first side and second side of said case to define an interior surface of said case b. a first internal pocket having a first fastener element adjacent to an opening of said first pocket; and c. a second externally accessible pocket protruding through one of the first side and second side of the case into an internal space of the case defined between the first side and the second side, said second pocket sized and configured to hold a personal gun cleaning kit selectively worn by a gun user;

an apron comprised of a sheet of solvent-resistant fabric having a second fastener element complementary to said first fastener element, said apron being selectively positionable between a first stored position folded within said first internal pocket and a second deployed position unfolded outside of said internal pocket, said unfolded apron defining a gun cleaning work area; and a plurality of gun cleaning implements.

11. A gun cleaning tool kit in accordance with claim 10 wherein said gun cleaning kit further comprises a tool insert defining a plurality of cavities for selectively holding a plurality of gun cleaning implements.

12. A gun cleaning tool kit in accordance with claim 11 wherein said gun cleaning kit further comprises a first fastener element affixed to interior surface of the case, and said tool insert further comprises a second fastener element complementary to the first fastener element and said second fastener element is selectively detachable from said first fastener element.

13. A gun cleaning tool kit in accordance with claim 12 wherein said first fastener element affixed to the interior of the case is elongated and said second fastener element affixed to the tool insert is a clamping element.

14. A gun cleaning tool kit in accordance with claim 13 further comprising a personal gun cleaning tool kit configured to be selectively attached to equipment worn by a gun user, said personal gun cleaning tool kit comprising a second case having an interior surface; a second elongated attachment element affixed to the interior surface of the second case, said second elongated attachment element being compatible with the clamping element of the tool insert.

15. A gun cleaning tool kit in accordance with claim 10 wherein the plurality of gun cleaning implements includes a brush, a rod, and a swab.

16. A gun cleaning tool kit in accordance with claim 15 wherein said plurality of gun cleaning implements further comprises gun cleaning solvent.

17. A gun cleaning tool kit in accordance with claim 16 wherein said plurality of gun cleaning implements further includes lens cleaning solvent and a lens cleaning cloth.

* * * * *